US007513795B1

(12) United States Patent
Shaw

(10) Patent No.: US 7,513,795 B1
(45) Date of Patent: Apr. 7, 2009

(54) COMPRESSION TYPE COAXIAL CABLE F-CONNECTORS

(75) Inventor: Glen David Shaw, Conway, AR (US)

(73) Assignee: DS Engineering, LLC, North Little Rock, AR (US)

( * ) Notice: Subject to any disclaimer, the term of this patent is extended or adjusted under 35 U.S.C. 154(b) by 0 days.

(21) Appl. No.: 12/002,261

(22) Filed: Dec. 17, 2007

(51) Int. Cl.
*H01R 9/05* (2006.01)

(52) U.S. Cl. ..... 439/578; 439/583; 439/584; 439/585

(58) Field of Classification Search ..... 439/578, 439/583–585
See application file for complete search history.

(56) References Cited

U.S. PATENT DOCUMENTS

| | | | |
|---|---|---|---|
| D148,897 | S | 3/1948 | Ward |
| D181,302 | S | 10/1957 | Logan |
| 3,686,623 | A | 8/1972 | Nijman |
| 3,710,005 | A | 1/1973 | French |
| D241,341 | S | 9/1976 | Oxley |
| 4,593,964 | A | 6/1986 | Forney, Jr. |
| 4,684,201 | A | 8/1987 | Hutter |
| 4,746,305 | A | 5/1988 | Nomura |
| RE32,787 | E | 11/1988 | Gallusser |
| 4,834,675 | A | 5/1989 | Samchusen |
| D313,222 | S | 12/1990 | Takizawa |
| 4,990,106 | A | 2/1991 | Szegda |
| 5,024,606 | A | 6/1991 | Ming |
| D327,872 | S | 7/1992 | McMills |
| D339,568 | S | 9/1993 | Salz |
| 5,389,012 | A | 2/1995 | Huang |
| 5,470,257 | A | 11/1995 | Szegda |
| 5,632,651 | A | 5/1997 | Szegda |
| 5,820,408 | A | 10/1998 | Wang |
| 5,863,226 | A | 1/1999 | Lan |
| 5,934,137 | A | 8/1999 | Tarpill |
| 5,975,949 | A | 11/1999 | Holliday |
| 6,065,976 | A | 5/2000 | Wang |
| 6,113,431 | A | 9/2000 | Wong |
| 6,139,344 | A | 10/2000 | Wang |
| 6,146,197 | A | 11/2000 | Holliday |
| 6,153,830 | A | 11/2000 | Montena |
| 6,159,046 | A | 12/2000 | Wong |
| D436,076 | S | 1/2001 | Montena |
| 6,179,656 | B1 | 1/2001 | Wong |
| D437,826 | S | 2/2001 | Montena |
| D440,539 | S | 4/2001 | Montena |
| D440,939 | S | 4/2001 | Montena |

(Continued)

*Primary Examiner*—Tho D Ta
(74) *Attorney, Agent, or Firm*—Stephen D. Carver

(57) ABSTRACT

Axially compressible, high bandwidth F-connectors designed for conventional installation hand tools for interconnection with coaxial cable. Each connector has a rigid nut that is axially and rotatably secured to a molded plastic, tubular body. A rigid, conductive post coaxially extends through the connector, linking the nut and body. A post barbed end penetrates the cable within the connector. The body has a tubular shank with an obstruction-free surface and an integral stop ring. A tubular, metallic end cap is slidably fitted to the body shank, and thereafter forcibly compressed lengthwise, with travel limited by the stop ring. No detented structure is formed on the body, and the end cap can irreversibly assume any position, being held by end cap teeth. A tactile system comprising convex projections on the stop ring complemented by a resilient O-ring on the end cap helps installers determine correct placement through the sense of touch.

7 Claims, 11 Drawing Sheets

U.S. PATENT DOCUMENTS 6,234,838 B1 5/2001 Wong
6,386,912 B1 5/2002 Li
D458,904 S 6/2002 Montena
D460,739 S 7/2002 Fox
D461,166 S 8/2002 Montena
D461,167 S 8/2002 Montena
D461,778 S 8/2002 Fox
D462,058 S 8/2002 Montena
D462,060 S 8/2002 Fox
D462,327 S 9/2002 Montena
6,478,618 B2 11/2002 Wong
D468,696 S 1/2003 Montena
6,530,807 B2 3/2003 Rodrigues
6,558,194 B2 5/2003 Montena
D475,975 S 6/2003 Fox
D475,976 S 6/2003 Montena
D475,977 S 6/2003 Montena
6,716,062 B1 4/2004 Palinkas
6,733,336 B1 5/2004 Montena
6,767,247 B2 7/2004 Rodrigues
6,767,248 B1 * 7/2004 Hung ..... 439/578
6,767,249 B1 7/2004 Li
6,769,926 B1 8/2004 Montena
6,776,657 B1 8/2004 Hung
6,780,052 B2 8/2004 Montena
6,817,897 B2 11/2004 Chee
6,848,940 B2 2/2005 Montena
D503,685 S 4/2005 Montena
D504,113 S 4/2005 Montena
D504,114 S 4/2005 Montena
D504,402 S 4/2005 Montena
6,884,113 B1 4/2005 Montena
D505,391 S 5/2005 Rodrigues
D506,446 S 6/2005 Montena
6,908,337 B1 6/2005 Li
6,910,919 B1 6/2005 Hung
D507,242 S 7/2005 Montena
6,929,507 B2 8/2005 Lin
D511,497 S 11/2005 Murphy
D511,498 S 11/2005 Holliday
D512,024 S 11/2005 Murphy
D512,689 S 12/2005 Murphy
D513,406 S 1/2006 Rodrigues
D513,736 S 1/2006 Fox
D514,071 S 1/2006 Vahey
D515,037 S 2/2006 Fox
7,018,235 B1 * 3/2006 Burris et al. ..... 439/584
D518,772 S 4/2006 Fox
D519,076 S 4/2006 Fox
D519,451 S 4/2006 Fox
D519,452 S 4/2006 Rodrigues
D519,453 S 4/2006 Rodrigues
D519,463 S 4/2006 Tamezane
7,021,965 B1 4/2006 Montena
D521,454 S 5/2006 Murphy
D521,930 S 5/2006 Fox
7,063,551 B1 6/2006 Lin
D535,259 S 1/2007 Rodrigues
7,192,308 B2 3/2007 Rodrigues
D543,948 S 6/2007 Montena
D544,837 S 6/2007 Disbennett
7,241,172 B2 7/2007 Rodrigues
7,364,462 B2 * 4/2008 Holland ..... 439/584
2002/0146935 A1 10/2002 Wong
2004/0147164 A1 7/2004 Li

* cited by examiner

COMPRESSION TYPE COAXIAL CABLE F-CONNECTORS

BACKGROUND OF THE INVENTION

1. Field of the Invention

The present invention relates generally to electrical connectors for coaxial cables and related electrical fittings. More particularly, the present invention relates to coaxial F-connectors of the axial compression type which are adapted to be installed with hand compression tools. Known prior art of relevance is classified in U.S. Pat. No. Class 439, Subclasses 583 and 584.

2. Description of the Related Art

A variety of coaxial cable connectors have been developed in the electronic arts for interfacing coaxial cable with various fittings. Famous older designs that are well known in the art, such as the Amphenol PL-259 plug, require soldering and the hand manipulation of certain components during installation. One advantage of the venerable PL-259 includes the adaptability for both coaxial cables of relatively small diameter, such as RG-59U or RG-58U, and large diameter coaxial cable (i.e., such as RG-8U, RG-9U, LMR-400 etc.). So-called N-connectors also require soldering, but exhibit high frequency advantages. Numerous known connectors are ideal for smaller diameter coaxial cable, such as RG-58U and RG-59U. Examples of the latter include the venerable "RCA connector", which also requires soldering, and the well known "BNC connector", famous for its "bayonet connection", that also requires soldering with some designs.

Conventional coaxial cables typically comprise a solid or stranded center conductor surrounded by a plastic, dielectric insulator and a coaxial shield of braided copper and foil. An outer layer of insulation, usually black in color, coaxially surrounds the cable. To prepare coaxial cable for connector installation, a length of the outer jacket is removed, exposing a portion of the shield that is drawn back and coaxially positioned. A portion of the insulated center is stripped so that an exposed portion the inner copper conductor can become the male prong of the assembled F-connector.

The modern F-type coaxial cable connector has surpassed all other coaxial connector types in volume. These connectors are typically used in conjunction with smaller diameter coaxial cable, particularly RG-6 cable and the like. The demand for home and business wiring of cable TV system, home satellite systems, and satellite receiving antenna installations has greatly accelerated the use of low-power F-connectors. Typical F-connectors comprise multiple pieces. Typically, a threaded, hex-head nut that screws into a suitable socket commonly installed on conventional electronic devices such as televisions, satellite receivers and accessories, satellite radios, and computer components and peripherals. The connector body mounts an inner, generally cylindrical post that extends coaxially rearwardly from the hex nut. When a prepared end of the coax is inserted, the post penetrates the cable, sandwiching itself between the insulated cable center and the outer conductive braid. A deflectable, rear locking part secures the cable within the body of the connector after compression. The locking part is known by various terms in the art, including "cap", or "bell" or "collar" or end sleeve and the like. The end cap, which may be formed of metal or a resilient plastic, is compressed over or within the connector body to complete the connection. A seal is established by one or more O-rings or grommets. Suitable grommets may comprise a silicone elastomer.

The design of typical modern F-connectors is advantageous. First, typical assembly and installation of many F-connector designs is completely solderless. As a result, installation speed increases. Further, typical F-connectors are designed to insure good electrical contact between components. The outer conductive braid for the coaxial cable, for example, is received within the F-connector, and frictional and/or compressive contact insures electrical continuity. For satellite and cable installations the desired F-connector design mechanically routes the inner, copper conductor of the coaxial cable through the connector body and coaxially out through the mouth of the connector nut to electrically function as the male portion of the connector junction without a separate part.

An important F-connector design innovation relates to the "compression-type" F-connector. Such designs typically comprise a metallic body pivoted to a hex-head nut for electrical and mechanical interconnection with a suitably threaded socket. A rigid conductive post is coaxially disposed within the connector body, and is adapted to contact the conductive outer braid of the coax when the prepared cable end is installed. After insertion of the stripped end of the coax, the rear connector cap or collar is forcibly, axially compressed relative to the connector body. A suitable hand operated compression tool designed for compression F-connectors is desirable. Some connector designs have an end cap adapted to externally mount the body, and some designs use a rear cap that internally engages the F-connector body. In some designs the cap is metal, an in others it is plastic. In any event, after the cap is compressed, the braided shield in electrically connected and mechanically secured, and a tip of the exposed copper center conductor properly extends from the connector front. The outer conductive braid is compressively forced against internal metal components to insure proper electrical connections.

One popular modern trend with compression F-connectors involves their preassembly and packaging. In some preassembled designs the rear sleeve (i.e., or end cap, collar etc.) is compressively forced part-way unto or into the connector body prior to bulk packaging. The end sleeve is pre-connected to the connector end by the manufacturer to ease the job of the installer by minimizing or avoiding installation assembly steps. For example, when the installer reaches into his or her package of connectors, he or she need draw out only one part, or connector, and need not sort connector bodies from connector end caps or sleeves and assemble them in the field, since the device end cap is already positioned by the manufacturer. Because of the latter factors, installation speed is increased, and component complexity is reduced.

Typically, preassembled compression F-connector designs involve locking "detents" that establish two substantially fixed positions for the end cap along the length of the connector body. The cap, for example, may be provided with an internal lip that surmounts one or more annular ridges or grooves defined on the connector collar for the mechanical detent. In the first detent position, for example, the end cap yieldably assumes a first semi-fixed position coupled to the lip on the connector end, where it semi-permanently remains until use and installation. The connection force is sufficient to yieldably maintain the end cap in place as the F-connectors are manipulated and jostled about. During assembly, once a prepared cable end is forced through the connector and its end cap, the connector is placed within a preconfigured void within and between the jaws of a hand-operated compression installation tool, the handles of which can be squeezed to force the connector parts together. During compression, in detented designs, the end cap will be axially forced from the first detent position to a second, compressed and "installed" detent position.

High quality F-connectors are subject to demanding standards and requirements. Modern home satellite systems distribute an extremely wide band signal, and as the demand for high definition television signals increases, and as more and more channels are added, the bandwidth requirements are becoming even more demanding. At present, F-connectors must reliably handle bandwidths approximating three GHz. As the significance of the latter factors increases, it becomes mandatory critical that the F-connector infallibly mate with the cable.

Disadvantages with prior art coaxial F-connectors are recognized. For example, moisture and humidity can interfere with electrical contact, degrading the signal pathway between the coax, the connector, and the fitting to which it is connected. For example, F-connectors use compression and friction to establish a good electrical connection between the braided shield of the coaxial cable and the connector body, as there is no soldering. Moisture infiltration, usually between the connector body and portions of the coaxial cable, can be detrimental. Signal degradation, impedance mismatching, and signal loss can increase over time with subsequent corrosion. Moisture infiltration often increases in response to mechanical imperfections resulting where coaxial compression connectors are improperly compressed.

Mechanical flaws caused by improper crimping or compression can also degrade the impedance or characteristic bandwidth of the connector, attenuating and degrading the required wide-band signal that modern TV satellite dish type receiving systems employ. If the axial compression step does not positively lock the end cap in a proper coaxial position, the end cap can shift and the integrity of the connection can suffer. Furthermore, particularly in modern, high-bandwidth, high-frequency applications involved with modern satellite applications distributing multiple high definition television channels, it is thought that radial deformation of internal coaxial parts, which is a natural consequence of radial compression F-connectors, potentially degrades performance.

Dealers and installers of satellite television equipment have created a substantial demand for stripping and installation tools for modern compression type F-connectors. However, installers typically minimize the weight and quantity of tools and connectors they carry on the job. There are a variety of differently sized and configured F-connectors, and a variety of different compression tools for installation.

On the one hand, F-connectors share the same basic shape and dimensions, as their connecting nut must mate with a standard thread, and the internal diameter of critical parts must accommodate standard coaxial cable. On the other hand, some compression F connectors jam the end sleeve or cap into the body, and some force it externally. Some connectors use a detent system, as mentioned above, to yieldably hold the end sleeve or cap in at least a first temporary position. Still other connectors require manual assembly of the end cap to the body of the connector. In other words, size differences exist in the field between the dimensions of different F-connectors, and the tools used to install them.

The typical installer carries as few tools as practicable while on the job. He or she may possess numerous different types of connectors. Particularly with the popularity of the "detented" type of compression F-connector, hand tools customized for specific connector dimensions have arisen. The internal compression volume of the hand tool must match very specific "before" and "after" dimensions of the connector for a precision fit. After a given compression F-connector is preassembled, then penetrated by the prepared end of a segment of coaxial cable, the tool must receive and properly "capture" the connector. The most popular compression tools are known as "saddle" types, or "fully enclosed" types. In either event the tool must be sized to comfortably receive and "capture" connectors of predetermined external dimensions. Tools are designed for proper compression deflection, so the connector assumes a correct, reduced length after compression. Popular tools known in the art are available fro the Ripley Company, model 'Universal FX', the 'LCCT-1' made by International Communications, or the ICM 'VT200' made by the PPC Company.

I have found that connector failures often result from small mechanical misalignments that result where the internal compression volume of the installation tool does not properly match the size of the captured connector. The degree of internal tool compression should closely correlate with the reduced length of the connector after axial deflection. In other words, the end sleeve or cap must be forcibly displaced a correct distance. Wear and tear over time can mismatch components. In other words, where hand tools designed for a specific connector length are used with connectors of slightly varying sizes, as would be encountered with different types or brands of connectors, improper and incomplete closure may result. Misdirected compression forces exerted upon the end cap or sleeve and the connector body or during compression can cause deformation and interfere with alignment. The asymmetric forces applied by a worn or mismatched saddle type compression tool can be particularly detrimental. Sometimes improper contact with internal grommets or O-rings results, affecting the moisture seal.

The chance that a given compression hand tool, used by a given installer, will mismatch the particular connectors in use at a given time is often increased when the connectors are of the "detent" type. Detented compression connectors, examples of which are discussed below, are designed to assume a predetermined length after both preassembly, and assembly. Thus detented F-connectors require a substantially mating compression tool of critical dimensions for proper performance. The chances that a given installer will install the requested compression F-connectors involved at a given job, or specified in a given installation contract, with the correctly sized, mating installation tool are less than perfect in reality. Another problem is that detented F-connector, even if sized correctly and matched with the correct installation tool, may not install properly unless the installer always exerts the right force by fully deflecting the tool handles. Even if a given installation tool is designed for the precise dimensions of the connectors chosen for a given job, wear and tear over the life of the hand tool can degrade its working dimensions and tolerances. Real world variables like these can conclude with an incorrectly installed connector that does not reach its intended or predetermined length after assembly.

If and when the chosen compression tool is not correctly matched to the F-connector, deformation and damage can occur during installation, particularly with detented compression F-connectors. Another problem occurs where an installer improperly positions the connector within the hand tool. Experienced installers, who may have configured and installed thousands of F-connectors over the years, often rely upon a combination of "look" and "feel" during installation when fitting connectors to the cable, and when positioning the connectors in the hand tool. Repetition and lack of attention tends to breed sloppiness and carelessness. Improper alignment and connector placement that can cause axial deformation. Sloppiness in preparing a cable end for the connector can also be detrimental.

A modern, compression type F-connector of the compression type is illustrated in U.S. Pat. No. 4,834,675 issued May 30, 1989 and entitled "Snap-n-seal Coaxial Connector." The connector has an annular compression sleeve, an annular collar which peripherally engages the jacket of a coaxial cable, an internal post coaxially disposed within the collar that engages the cable shield, and a rotatable nut at the front for connection. A displaceable rear cap is frangibly attached to the body front, and must be broken away for connector installation manually and then pre-positioned by the user on the connector end. The end cap is axially forced into coaxial engagement within the tubular compression sleeve between the jacket of the coaxial cable and the annular collar, establishing mechanical and electrical engagement between the connector body and the coaxial cable shield.

U.S. Pat. No. 5,632,651 issued May 27, 1997 and entitled "Radial compression type Coaxial Cable end Connector" shows a compression type coaxial cable end connector with an internal tubular inner post and an outer collar that cooperates in a radially spaced relationship with the inner post to define an annular chamber with a rear opening. A threaded head attaches the connector to a system component. A tubular locking cap protruding axially into the annular chamber through its rear is detented to the connector body and is displaceable axially between an open position accommodating insertion of the tubular inner post into a prepared cable end, with an annular outer portion of the cable being received in the annular chamber, and a clamped position fixing the annular cable portion within the chamber.

Similarly, U.S. Pat. No. 6,767,247 issued Jul. 27, 2004 depicts a compression F-connector of the detent type. A detachable rear cap or end sleeve temporarily snap fits or detents to a first yieldable position on the connector rear. This facilitates handling by the installer. The detachable end sleeve coaxially, penetrates the connector body when installed, and the coaxial cable shield is compressed between the internal connector post and the end sleeve.

U.S. Pat. No. 6,530,807 issued Mar. 11, 2003, and entitled "Coaxial connector having detachable Locking Sleeve," illustrates another modern compression F-connector. The connector includes a locking end cap provided in detachable, re-attachable snap engagement within the rear end of the connector body for securing the cable. The cable may be terminated to the connector by inserting the cable into the locking sleeve or the locking sleeve may be detachably removed from the connector body and the cable inserted directly into the cable body with the locking sleeve detached subsequently.

U.S. Pat. No. 5,470,257 issued Nov. 28, 1995 shows a detented, compression type coaxial cable connector. A tubular inner post is surrounded by an outer collar and linked to a hex head. The radially spaced relationship between the post and the collar defines an annular chamber into which a tubular locking cap protrudes, being detented in a first position that retains it attached to the connector. After the tubular inner post receives a prepared cable end, the shield locates within the annular chamber, and compression of the locking cap frictionally binds the parts together.

U.S. Pat. No. 6,153,830 issued Nov. 28, 2000 shows a compression F-connector with an internal post member, and a rear end cap that coaxially mounts over the cable collar or intermediate body portion. The internal, annular cavity coaxially formed between the post and the connector body is occupied by the outer conductive braid of the coaxial cable. The fastener member, in a pre-installed first configuration is movably fastened onto the connector body. The fastener member can be moved toward the nut into a second configuration in which the fastener member coacts with the connector body so that the connector sealingly grips the coaxial cable. U.S. Pat. No. 6,558,194 issued May 6, 2003 and entitled "Connector and method of operation" and U.S. Pat. No. 6,780,052 issued Aug. 24, 2004 are similar.

U.S. Pat. No. 6,848,940 issued Feb. 1, 2005 shows a compression F-connector similar to the foregoing, but the compressible end cap coaxially mounts on the outside of the body.

Another detented compression F-connector is discussed in U.S. Pat. No. 6,848,940, issued Feb. 1, 2005 and entitled "Connector and method of Operation." The connector body coaxially houses an internal post that is coupled to the inner conductor of a coaxial cable. A nut is coupled to either the connector body or the post for the connecting to a device. The post has a cavity that accepts the center conductor and insulator core of a coaxial cable. The annulus between the connector body and the post locates the coaxial cable braid. The end cap or sleeve assumes a pre-installed first configuration temporarily but movably fastened to the connector body, a position assumed prior to compression and installation. The end cap can be axially forced toward the nut into an installed or compressed configuration in which it grips the coaxial cable.

Various hand tools that can crimp or compress F-connectors are known.

For example, U.S. Pat. No. 5,647,119 issued Jul. 15, 1997 and entitled "Cable terminating Tool" discloses a hand tool for compression type F-connectors. Pistol grip handles are pivotally displaceable. A pair of cable retainers pivotally supported on a tool holder carried by one of the handles releasably retains the cable end and a preattached connector in coaxial alignment with an axially moveable plunger. The plunger axially compresses the connector in response to handle deflection. The plunger is adjustable to adapt the tool to apply compression type connector fittings produced by various connector manufactures.

Another example is U.S. Pat. No. 6,708,396 issued Mar. 23, 2004 that discloses a hand-held tool for compressively installing F-connectors on coaxial cable. An elongated body has an end stop and a plunger controlled by a lever arm which forcibly, axially advances the plunger toward and away from the end stop to radially compress a portion of the connector into firm crimping engagement with the end of the coaxial cable.

Similarly, U.S. Pat. No. 6,293,004 issued Sep. 25, 2001 entitled "Lengthwise compliant crimping Tool" includes an elongated body and a lever arm which is pivoted at one end to the body to actuate a plunger having a die portion into which a coaxial cable end can be inserted. When the lever arm is squeezed, resulting axial plunger movements force a preassembled crimping ring on each connector to radially compress each connector into sealed engagement with the cable end, the biasing member will compensate for differences in length of said connectors.

BRIEF SUMMARY OF THE INVENTION

This invention provides improved, axial compression type F-connectors adapted to be quickly and reliably connected to coaxial cable. The new F-connectors are adapted to be readily manually manipulated for accurate placement within conventional compression hand tools for subsequent compressive installation.

Each connector has a rigid, metallic hex-headed nut for threadable attachment to conventional threaded devices. An elongated, preferably molded plastic body is rotatably and axially coupled to the nut. A rigid, conductive post coaxially extends through the nut and the tubular body, captivating the nut with an internal flange. A spaced apart end of the tubular post is barbed, to penetrate and receive an end of prepared coaxial cable fitted to the F-connector. A rigid, preferably metallic end cap is slidably fitted to the body, and thereafter forcibly compressed along the length of the body shank for installation.

Preferably the tubular body has a generally cylindrical stop ring that is integral and coaxial with a reduced diameter shank. The elongated outer periphery of the body's shank is smooth and free of obstacles. No detented structure is formed upon or machined into the external shank surface. The end cap has a tubular portion that externally, coaxially mounts the body shank, and which can be axially compressed relative to the body, such that the end cap and body are telescoped relative to one another. The end cap smoothly, frictionally grips the shank of the body, and it may be positioned at any point upon the shank as desired. However, maximum displacement in response to compression is limited by the integral stop ring axially adjoining the shank.

In the best mode the connector body has a tactile means enabling an installer or handler to readily feel and detect when the connector is positioned right for subsequent installation. Preferably the annular stop ring has at least one tactile region prominently formed upon its circumference. In the best mode, there are two tactile regions, each comprising a plurality of upwardly projecting convex projections that are arranged in orderly rows and/or columns. To complement the tactile design it is preferred that the end cap be provided with a resilient ring, seated within a suitable groove that is positioned to be spaced apart from the thumb of the installer.

Preferably the open mouth of the end cap has a plurality of radial "teeth" that firmly grasp the body shank. When the end cap is slidably telescoped upon the body shank, the teeth grasp the shank for a reliable mechanical connection without radially compressing or deforming the connector body. The end cap may assume any position along the length of body shank between the annular rear end of the body and the annular stop ring face. Cable is restrained within the connector by an internal jam point that resists axial withdrawal of the cable end.

Thus a basic object is to provide an improved, compression type electrical connector suitable for satellite and cable television systems.

Another basic object is to provide an improved compression-type F-connector that can be reliably used with a variety of different installation tools.

It is also an object to provide a compression type F-connector of the character described that facilitates a proper "capture" by various compression installation tools.

Another object is to provide a connector of the character described that is user-friendly and easily installed. The tactile features of my preferred invention make connector handling alignment easier and faster, simplifying the job of the installer.

A related object is to provide a compression type F-connector that provides an installer with useful tactile feedback enabling him or her to speed up the installation process while maintaining quality control and connection reliability.

It is also an important object to provide a compression type F-connector of the type disclosed that reliably provides a good electrical connection path between the threaded nut, the internal post, and the coaxial cable to which the connector is fitted.

A still further object is to provide a connector suitable for use with demanding large, bandwidth systems approximating three GHz.

A related object is to provide an F-connector ideally adapted for home satellite systems distributing multiple high definition television channels.

Another important object is to provide a connector of the character described that is weather proof and moisture resistant.

Another important object is to provide a compression F-connector of the character described that can be safely and properly installed without deformation of critical parts during final compression.

A related object is to provide a connector of the character described that reliably functions even when exposed to asymmetric compression forces.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
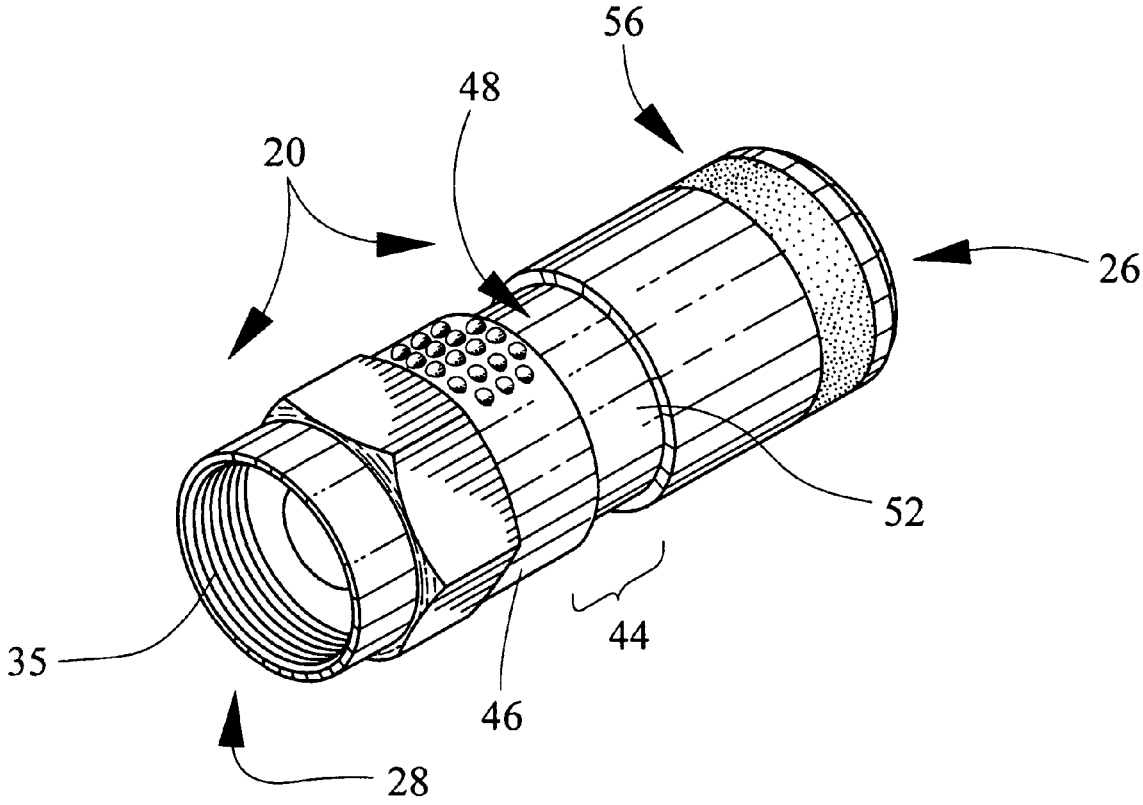
FIG. 1 is a longitudinal isometric view of the preferred connector, showing it in an uncompressed preassembly or "open" position.
Figure 4:
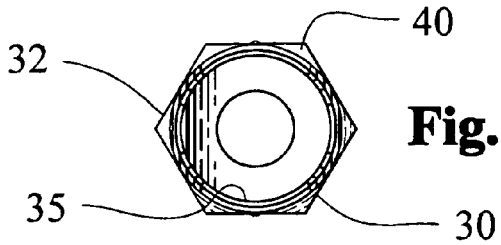
FIG. 4 is a front end view, taken from a position generally above FIG. 2 and looking down.
Figure 2:
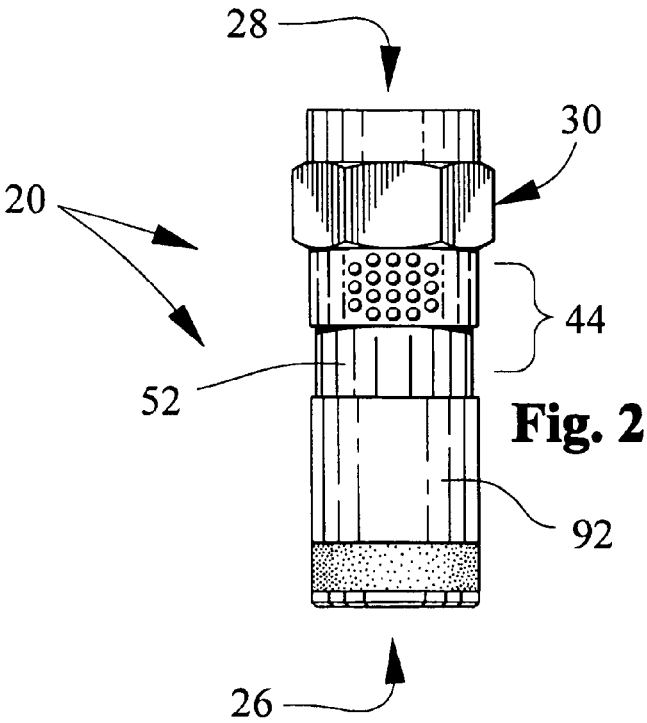
FIG. 2 is a longitudinal top plan view of the connector of FIG. 1, the bottom view substantially comprising a mirror image.

With initial reference directed to FIG. 1—of the appended drawings, an open F-connector for coaxial cable constructed generally in accordance with the best mode of the invention has been generally designated by the reference numeral 20. The same connector, when closed as in FIGS. 2 and 3 after compression, has been generally designated by the reference numeral 21. Connectors 20 and/or 21 are adapted to terminate an end of properly prepared coaxial cable, as will be discussed hereinafter in conjunction with the description of FIGS. 16-18. After a prepared end of coaxial cable is properly inserted through the open bottom end 26 of an open connector 20, the connector is placed within a suitable compression hand tool for compression, substantially assuming the closed configuration of FIG. 6.

Figure 11:
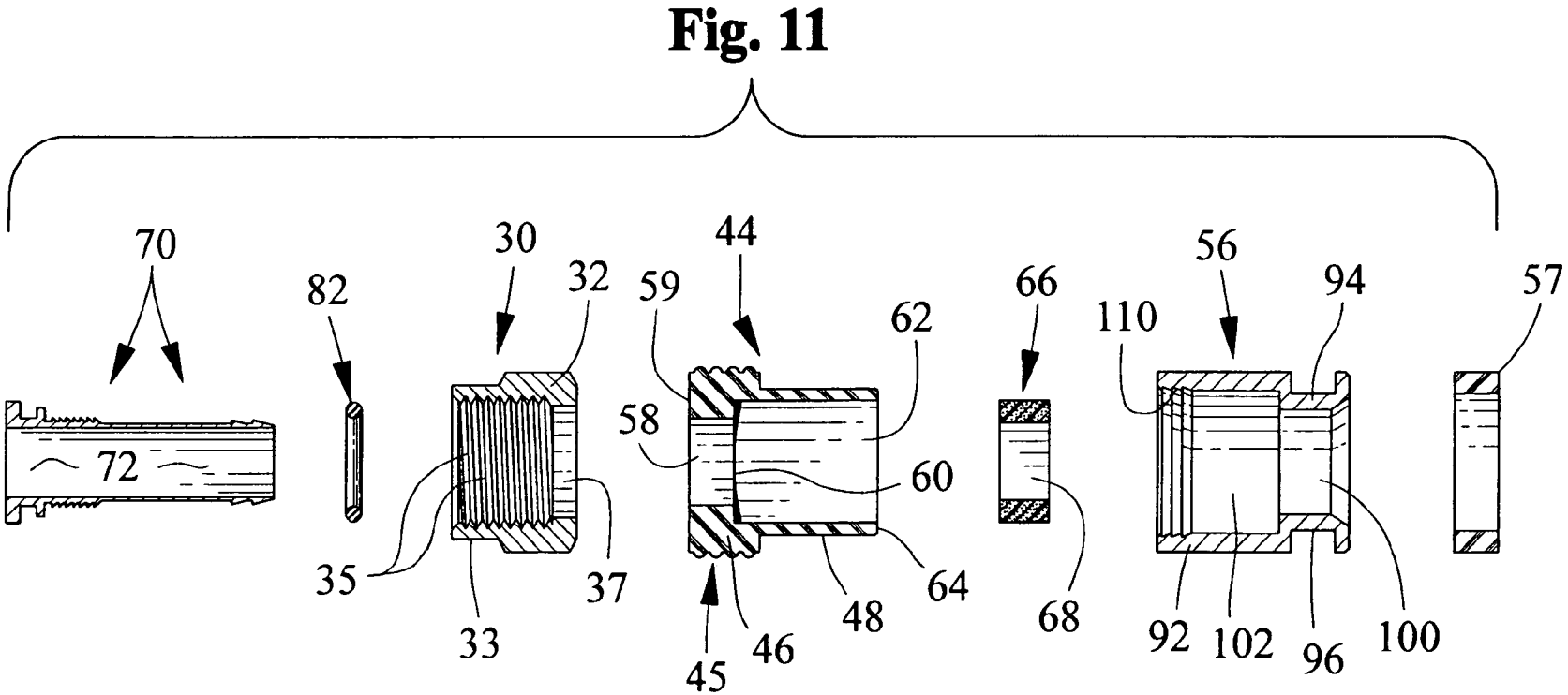
FIG. 11 is an exploded, sectional view of the preferred connector of FIG. 1.
Figure 13:
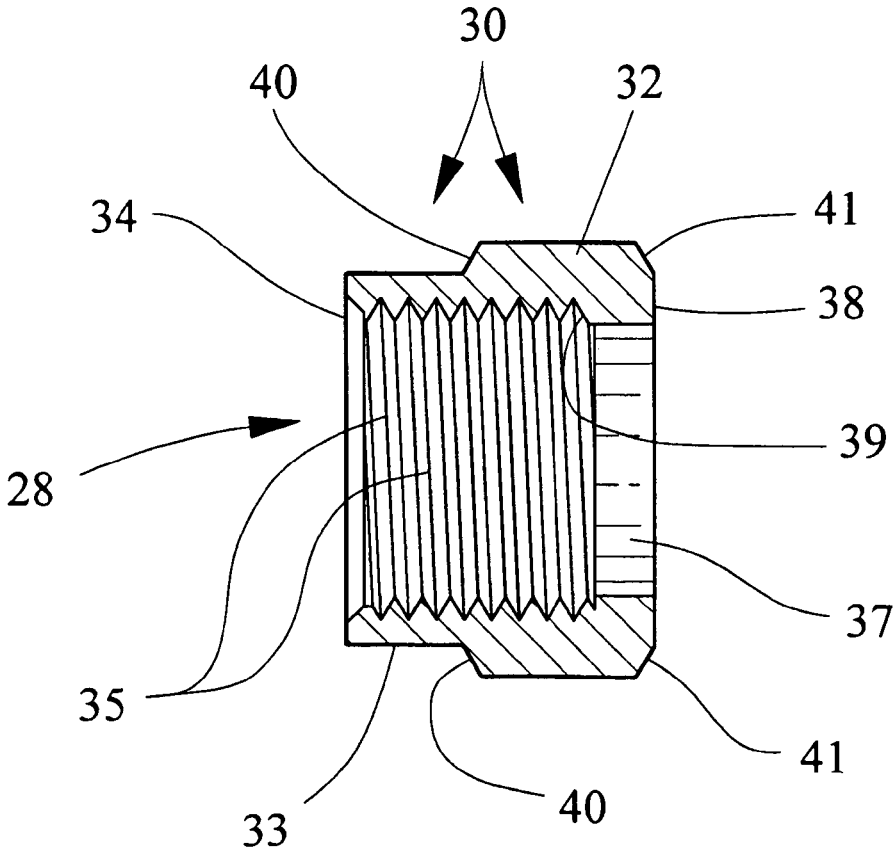
FIG. 13 is an enlarged, longitudinal sectional view of the preferred hex head.

With additional reference directed to FIGS. 11 and 13, the preferred rigid, tubular, metallic nut 30 has a conventional faceted, preferably hexagonal drive head 32 integral with a protruding, coaxial stem 33. Conventional, internal threads 35 are defined in the nut or head interior for rotatable, threadable mating attachment to a suitably-threaded socket. The open front mouth 28 of the connector (i.e., FIG. 1) appears at the front of stem 33 surrounded by annular front face 34 (FIG. 13). A circular passageway 37 is concentrically defined in the faceted drive head 32 at the rear of nut 30. Passageway 37 is externally, coaxially bounded by the outer, round peripheral wall 38 forming a flat, circular end of the connector nut 30. An inner, annular shoulder 39 on the inside of head 32 is spaced apart from and parallel with outer wall 38 (FIG. 13). A leading chamfer 40 and a spaced part rear chamfer 41 defined on hex head 32 are preferred for ease of handling.

An elongated, tubular body 44 preferably molded from plastic is rotatably coupled to the nut 30. Body 44 preferably comprises a tubular stop ring 46 (i.e., FIG. 14) that is integral with a reduced diameter shank 48 sized to fit as illustrated in FIG. 11. The elongated, outer periphery 52 of shank 48 is smooth and cylindrical. The larger diameter stop ring 46 has an annular, rear wall 54 that is coaxial with shank 48. An end cap 56 is pressed unto body 44, coaxially engaging the shank 48. The end cap 56 discussed hereinafter (i.e., FIGS. 11, 15) will smoothly, frictionally grip body 44 along and upon any point upon body shank 48, with maximum travel or displacement limited by stop ring 46. In other words, when the end cap 56 is compressed unto the body, and the connector 20, 21 assumes a closed position (i.e., FIG. 6), annular wall 54 on the body stop ring 46 will limit maximum deflection or travel of the end cap 56.

The resilient, preferably molded plastic body 44 is hollow. Stop ring 46 has an internal, coaxial passageway 58 extending from the annular front face 59 defined at the body front (i.e., FIG. 14) a major portion of the ring length. Passageway 58 extends to an inner, annular wall 60 that coaxially borders another passageway 62, which has a larger diameter than passageway 58. The elongated passageway 62 is coaxially defined inside shank 48 and extends to rear, annular surface 64 (FIG. 14) coaxially located at the rear end of the shank 48. For moisture sealing, it is preferred that an annular grommet 66 (FIG. 11) be inserted within passageway 62, coming to rest against inner, annular wall 60 (i.e., FIG. 14). Grommet 66 is preferably made of a silicone elastomer. The diameter of body shank passageway 62 (FIGS. 11, 14) is substantially the same as the outer diameter of grommet 66. However, the diameter of inner grommet passageway 68 is preferably less than the diameter of body passageway 58 (FIGS. 11, 14) to dependably frictionally engage the post 70 described below.

Figure 8:
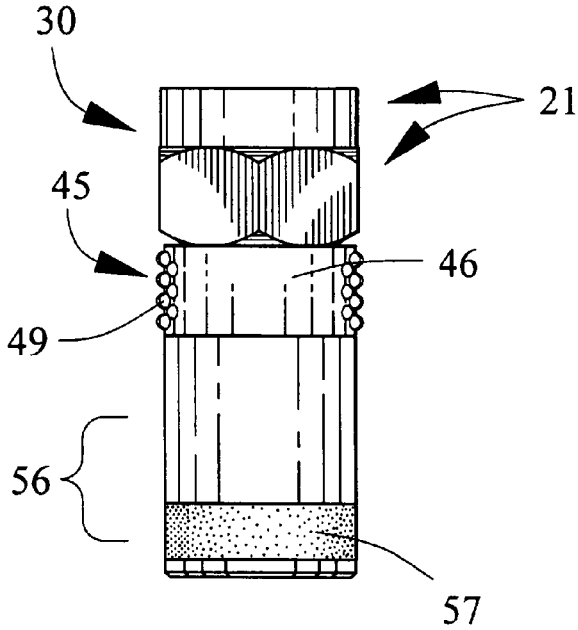
FIG. 8 is a longitudinal side elevational view of the closed connector of FIGS. 6 and 7, the opposite side view substantially comprising a mirror image.
Figure 9:
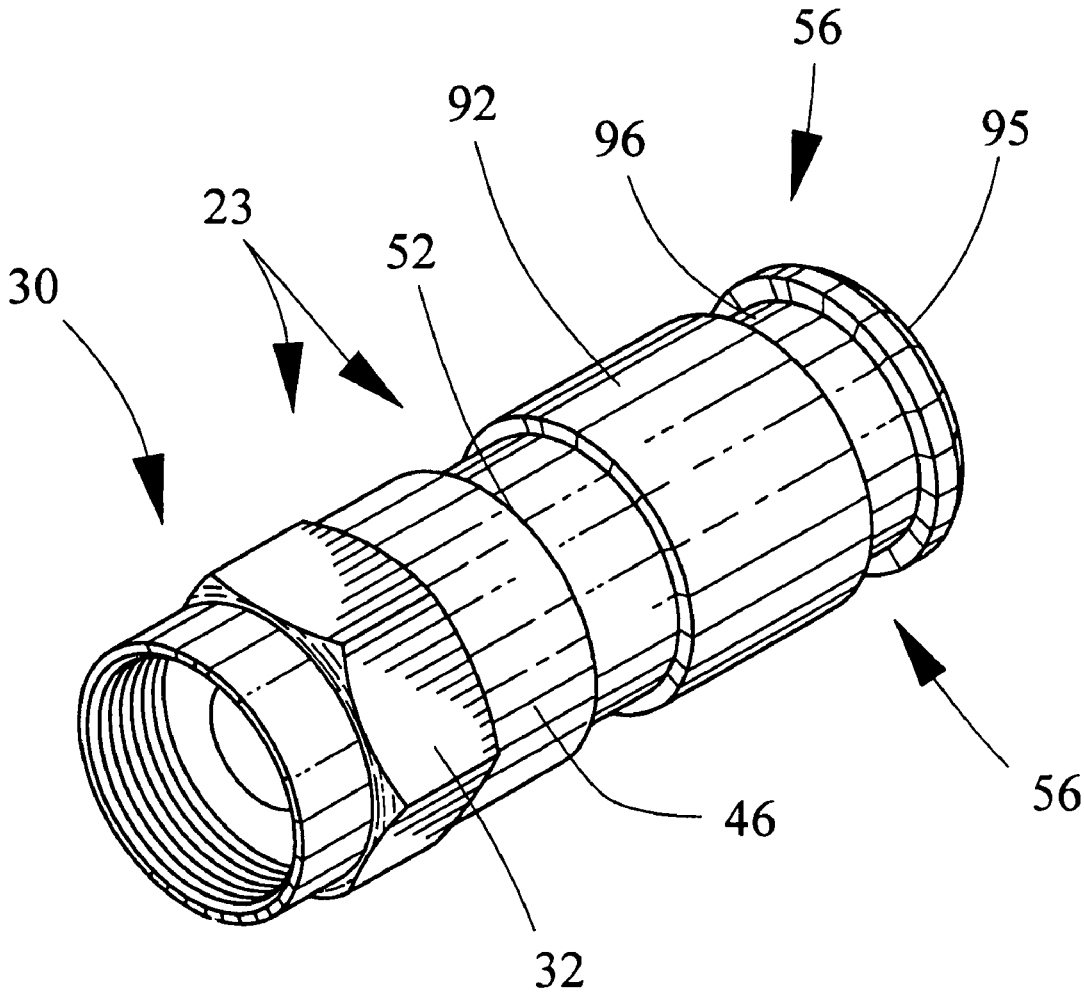
FIG. 9 is a longitudinal isometric view of an alternative preferred connector, showing it in an uncompressed preassembly or "open" position.
Figure 10:
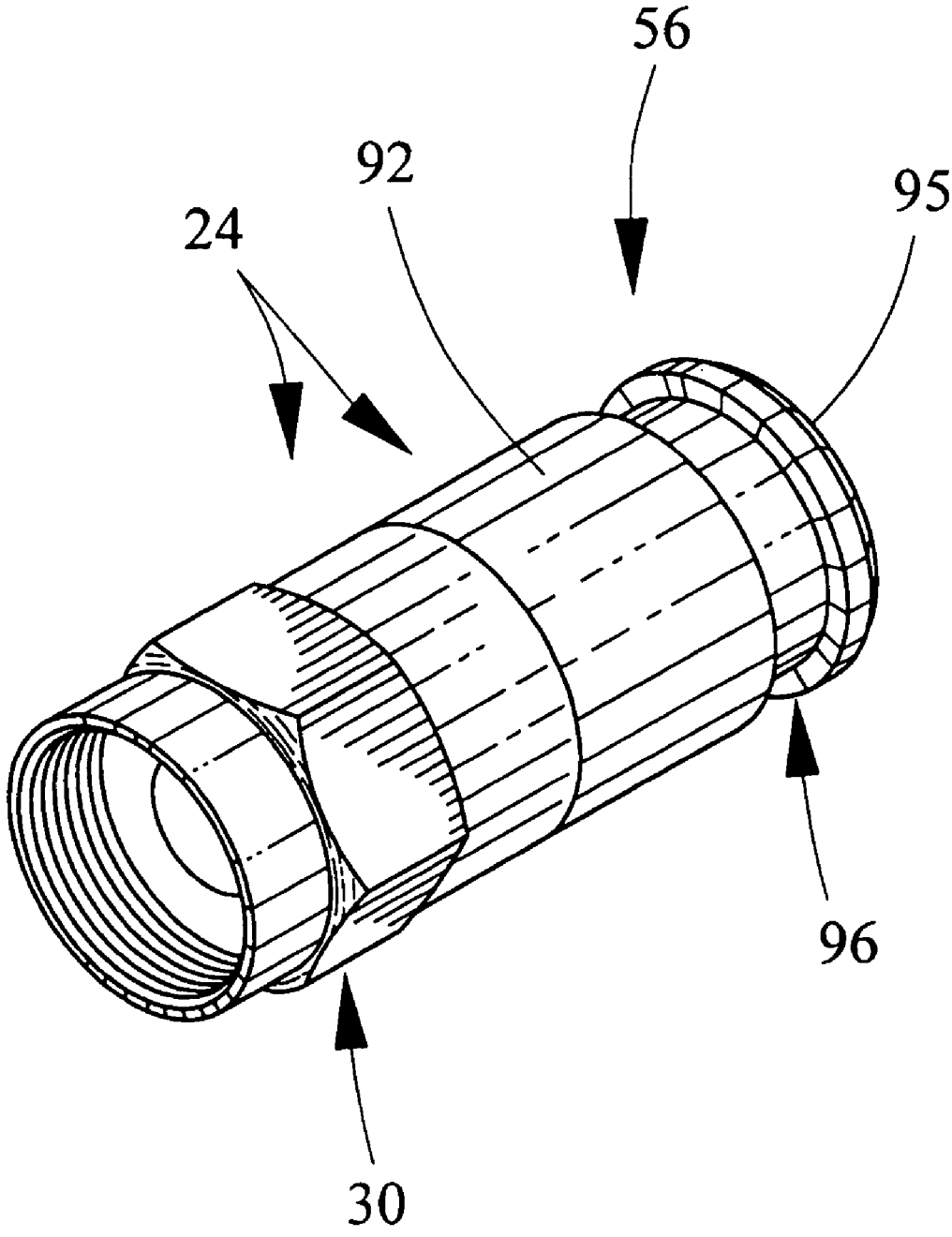
FIG. 10 is a longitudinal isometric view of the alternative connector of FIG. 9, showing it in a compressed or "closed" position.

Importantly, body 44 has a tactile means that is easily identified and recognized by an installer when he or she grasps a connector with his hand. The ring-shaped stop ring 46 defined on body 44 has at least one tactile region 45 prominently defined upon its external periphery to be appreciated by the sense of touch. As best seen in FIGS. 8 and 11, there are preferably two tactile regions 45, one on top and one on the bottom of the connector 20, 21. Each tactile region 45 preferably (i.e., FIGS. 1, 7, 11 and 14), comprises a plurality of regularly spaced apart, convex projections 49 rising upwardly away from the outer, cylindrical surface of the body's integral stop ring 46. The connectors 23, 24 in FIGS. 9 and 10 comprise an annular stop ring 46 as before, but there is no specific tactile surface defined upon it. Preferably these tactile projections 49 are arranged in orderly rows and/or columns. The tactile projections provide a definite "feel" when touched or grasped by an installer, who may grasp the connector between the thumb and forefinger, pressing against opposite tactile regions. The resultant tactile "feel" makes it easier to repetitively handle and position connectors on the job. The resultant tactile feedback allows the installer to conveniently manipulate and position the connector 20, 21 while forcing a prepared coax end through it, and to thereafter properly align the connector within the gripping mechanism of an installing tool conveniently and quickly. Proper connections can be made without tediously and continuously focusing ones eyes on the connector and coax. As explained later, a resilient ring 57 preferably attached to the end cap 56 enhances the overall tactile feel of the connectors 20, 21.

Figure 12:
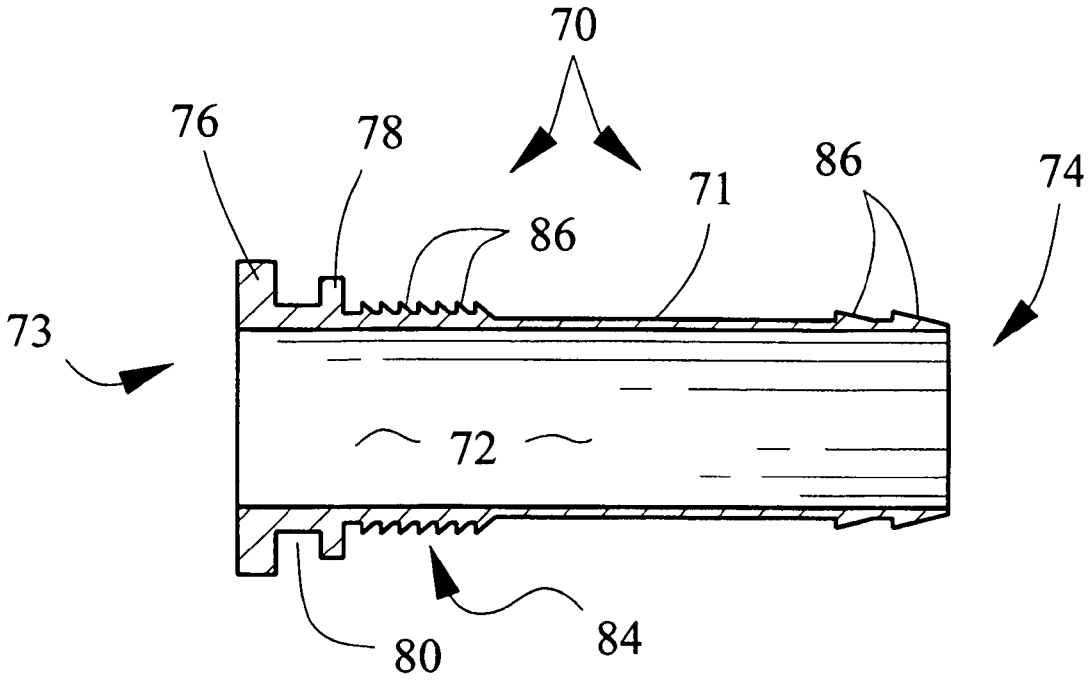
FIG. 12 is an enlarged, longitudinal sectional view of the preferred post.
Figure 14:
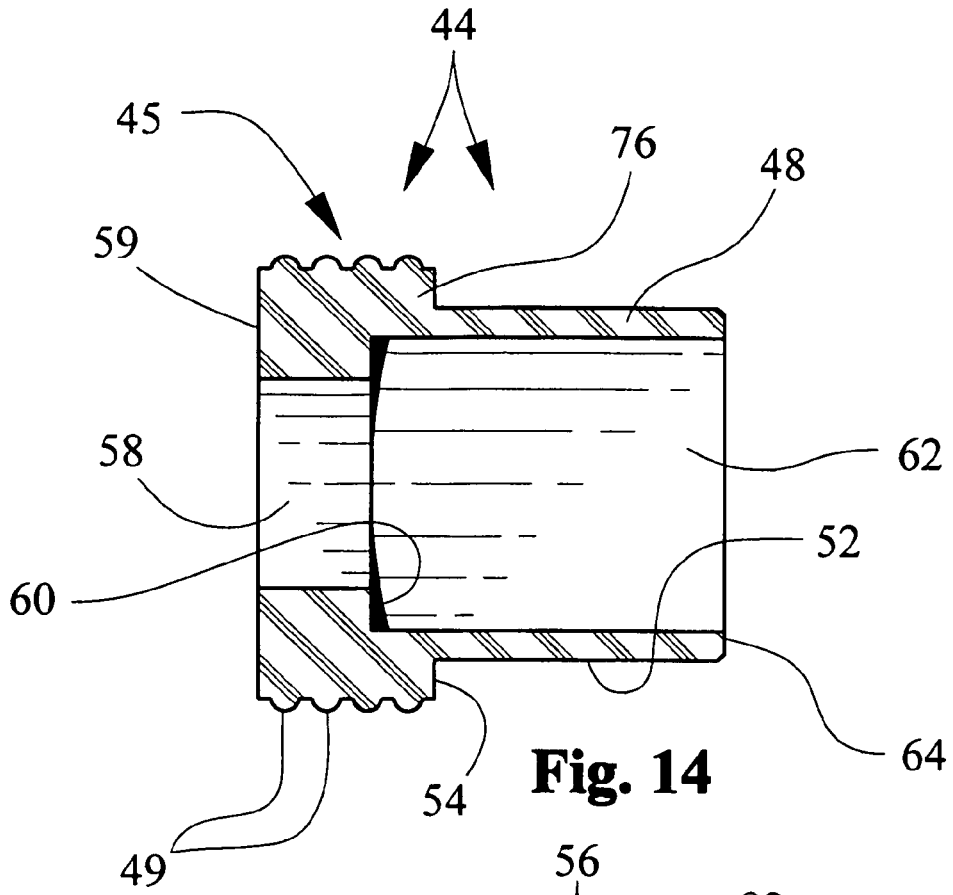
FIG. 14 is an enlarged, longitudinal sectional view of the preferred connector body.
Figure 16:
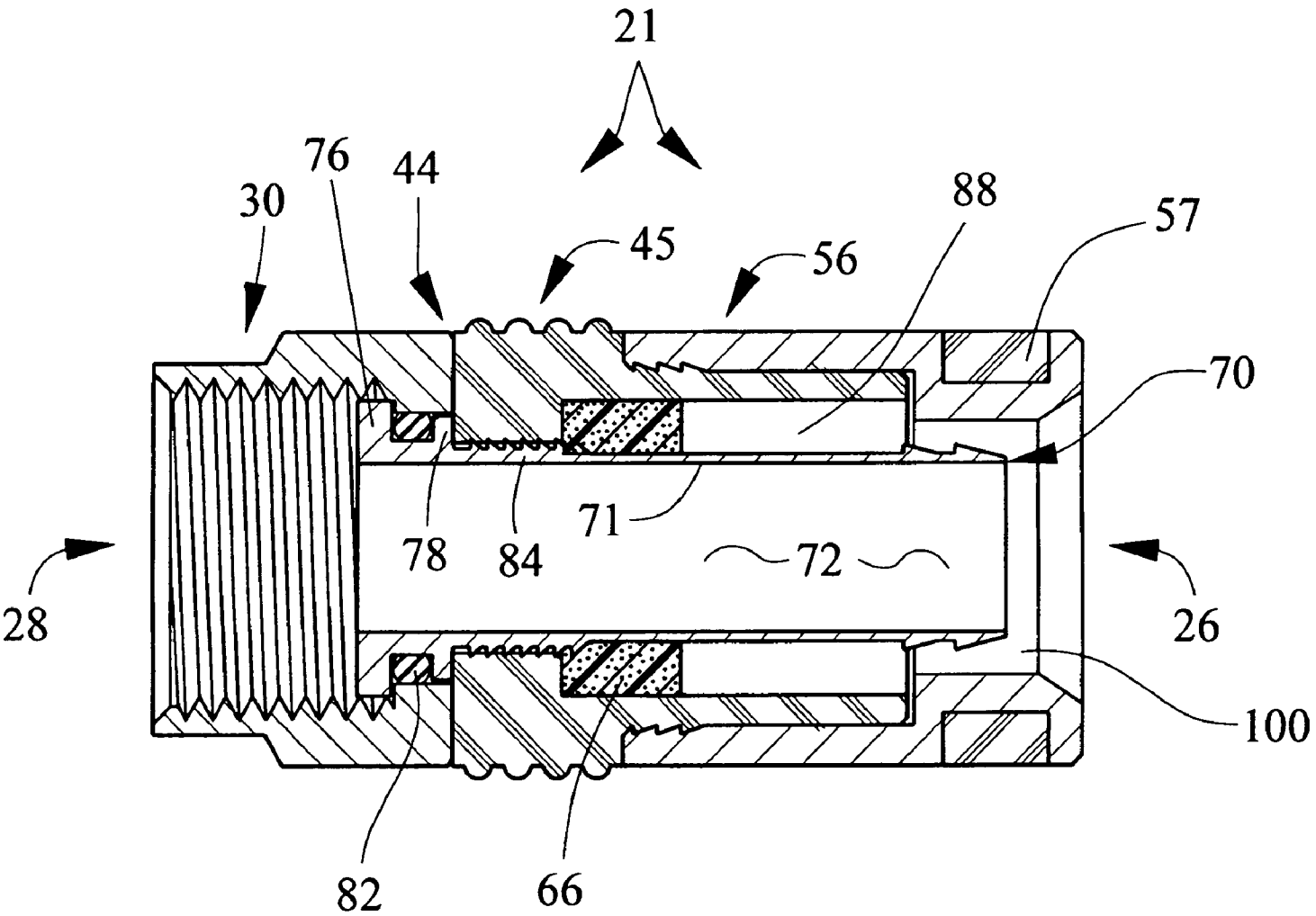
FIG. 16 is an enlarged, longitudinal sectional view of the preferred connector of FIG. 1, shown in the compressed position with no coaxial cable.

With primary reference directed now to FIGS. 11 and 12, the post 70 rotatably, mechanically couples the hex headed nut 30 to the plastic body 44. The metallic post 70 also establishes electrical contact between the braid of the coax (i.e., FIGS. 16-18) and the nut 30. The tubular post 70 defines an elongated shank 71 with a coaxial, internal passageway 72 extending between its front 73 and rear 74. A front, annular flange 76 is spaced apart from an integral, reduced diameter flange 78, across a ring groove 80. A conventional, resilient O-ring 82 is preferably seated within groove 80 when the connector is assembled. A barbed collar region 84 having multiple, external barbs 86 is press fitted into the body 44, frictionally seating within passageway 58 (i.e., FIG. 16) and partially penetrating the grommet 66. In assembly it is also noted that post flange 76 (i.e., FIGS. 12, 16) axially contacts inner head wall 39 (FIG. 13). Inner post flange 78 axially abuts front face 59 (FIG. 14) of body 44 with post 70 penetrating passageway 58. The sealing O-ring 82 is circumferentially frictionally constrained within nut 30 coaxially inside passageway 37 (FIGS. 13, 16). Finally, the rear end of post shank 71 has a pair of spaced-apart rings forming barbs 86 that penetrate the coaxial cable, such that the inner insulated coaxial cable conductor penetrates passageway 72 and enters the front mouth 28 formed by the nut 30. Also, the braided shield of the coax is positioned around the exterior of post shank 71, within annulus 88 (FIG. 16) coaxially formed within passageway 62 between post 70 and the shank 48 of body 44 (FIGS. 11, 14).

Figure 3:
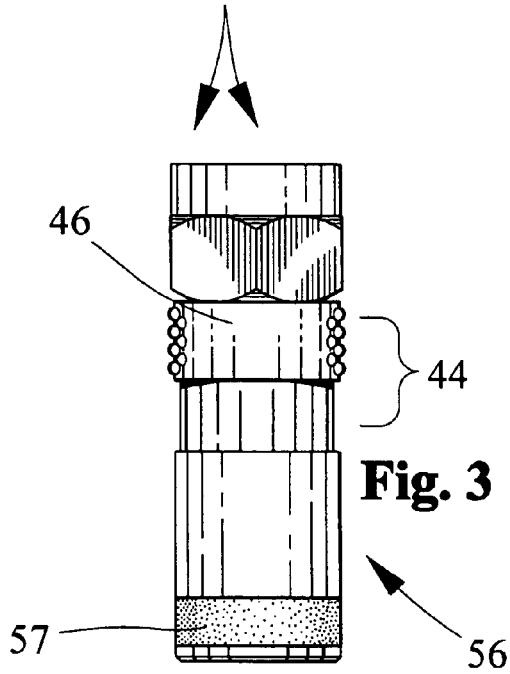
FIG. 3 is a longitudinal side elevational view of the connector of FIGS. 1 and 2, the opposite side view substantially comprising a mirror image.
Figure 5:
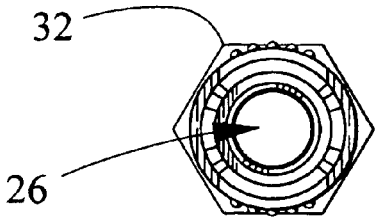
FIG. 5 is a rear end view, taken from a position generally below FIG. 2 and looking up.
Figure 6:
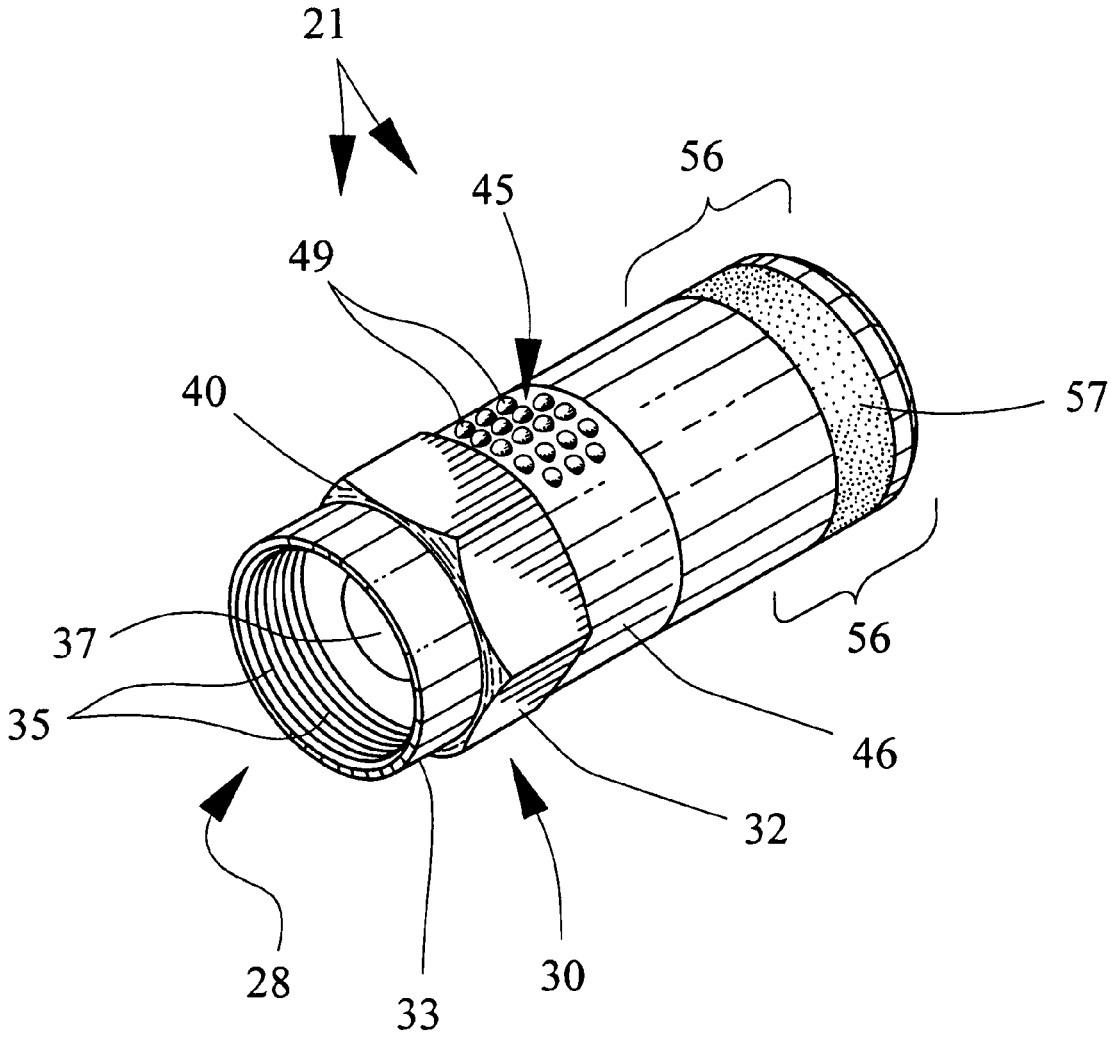
FIG. 6 is a longitudinal isometric view of the preferred connector similar to FIG. 1, but showing it in a compressed, or "closed" position it assumes after compression.
Figure 7:
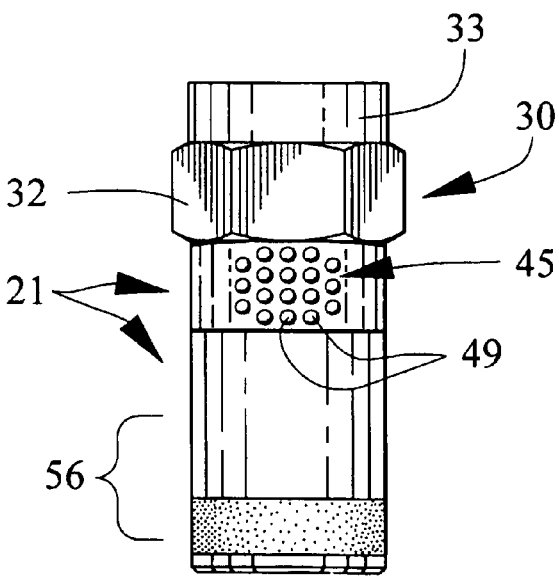
FIG. 7 is a longitudinal top plan view of the closed connector of FIG. 6, the bottom view substantially comprising a mirror image.
Figure 15:
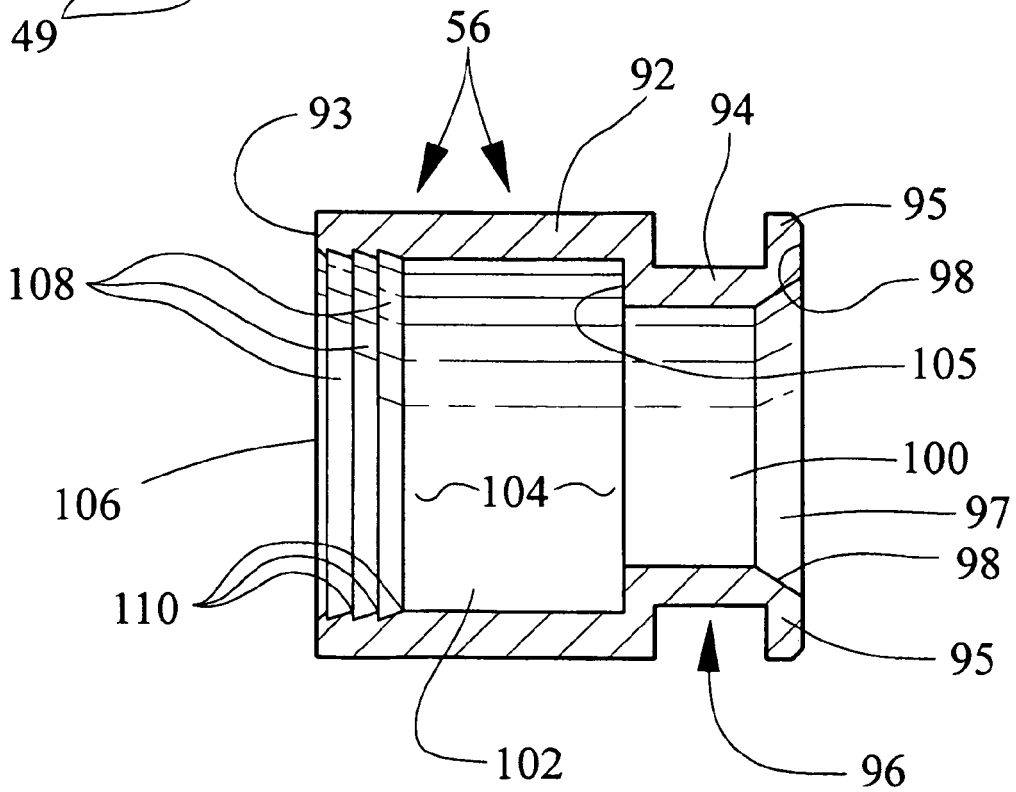
FIG. 15 is an enlarged, longitudinal sectional view of the preferred end cap.

The preferred end cap 56 is best illustrated in FIGS. 5, 11 and 15. The rigid, preferably metallic end cap 56 comprises a tubular body 92 that is integral and concentric with a rear neck 94 of reduced diameter. The neck 94 terminates in an outer, annular flange 95 forming the end cap rear and defining a coaxial cable input hole 97 with a beveled peripheral edge 98. In all embodiments 20, 21 (FIGS. 2, 6) and 23, 24 (FIGS. 9, 10), an annular ring groove 96 concentrically defined about neck 94 (FIG. 15). The ring groove 96 is axially located between body 92 and flange 95. The front of the end cap 56, and the front of body 92 (FIG. 15) is defined by concentric, annular face 93. The external ring groove 96 is readily perceptible by touch. However, it is preferred that resilient ring 57 (FIG. 11) be seated within groove 96 in embodiments 20, 21 as seen in FIGS. 3 and 6.

Hole 97 at the rear of end cap 56 (FIG. 15) communicates with cylindrical passageway 100 concentrically located within neck 94. Passageway 100 leads to a larger diameter passageway 102 defined within end cap body 92. Passageway 102 is sized to frictionally, coaxially fit over shank 48 of connector body 44 in assembly. There is an inner, annular wall 105 concentrically defined about neck 94 and facing within large passageway 102 within body 92 that is a boundary between end cap body 92 and end cap neck 94. Once a prepared end of coaxial cable is pushed through passageways 100, and 102 it will expanded in diameter as it is axially penetrated by post 70, and subsequent withdrawal from the connector will be resisted by contact with internal wall 105.

The smooth concentric outer surface of the connector body's shank 48 (i.e., FIG. 11) fits snugly within end cap passageway 102 when the end cap 56 is telescopingly, slidably fitted to the connector body 44. Cap 56 may be firmly pushed unto the connector body 44 and then axially forced a minimal, selectable distance to semi-permanently retain the end cap 56 in place on the body (i.e., coaxially frictionally attached to shank 48). There is no critical detented position that must be assumed by the end cap. The inner smooth cylindrical surface 104 of the end cap 56 is defined concentrically within body 92 (FIG. 15). Surface 104 coaxially, slidably mates with the smooth, external cylindrical surface 52 (FIG. 14) of the body shank 48. Thus the end cap 56 may be partially, telescopingly attached to the body 44, and once coax is inserted as explained below, end cap 56 may be compressed unto the body, over shank 48, until the coax end is firmly grasped and the parts are locked together. It is preferred however that the open mouth 106 at the end cap front have a plurality of concentric, spaced apart beveled rings 108 providing the end cap interior surface 104 with peripheral edges or "teeth" 110 that firmly grasp the body shank 48 (i.e., FIGS. 11, 14). Preferably there are three such "teeth" 110.

When the end cap 56 is compressively mated to the body 44, teeth 110 can firmly grasp the plastic shank 48 and make a firm connection without radially compressing the connector body, which is not deformed in assembly. The end cap may be compressed to virtually any position along the length of body shank 48 between a position just clearing annular face 64 (i.e., FIG. 14) and the annular face 54 at the rear of the body stop ring 46 (FIG. 14). Maximum deflection of the end cap is limited when the front face 93 of the end cap (FIG. 15) forcibly contacts the annular rear wall 54 (FIG. 14) of the connector body 44.

Figure 17:
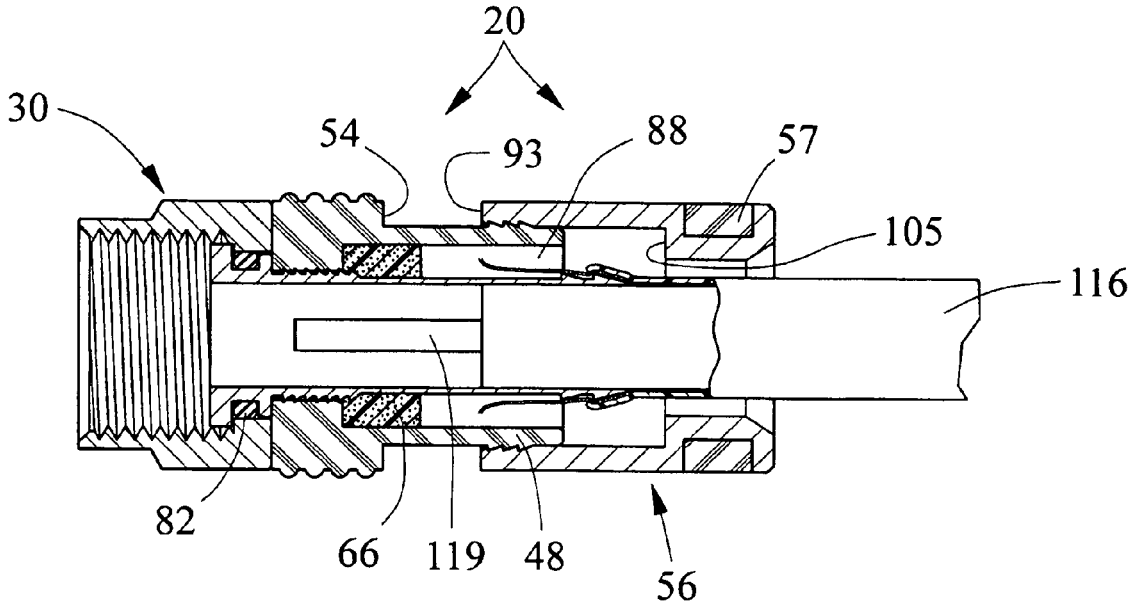
FIG. 17 is an enlarged, longitudinal sectional view of the preferred connector, shown in the "open" or uncompressed position with a prepared end of the coaxial cable inserted; and, FIG. 18 is an enlarged, longitudinal sectional view of the preferred connector shown in the compressed position and attached to a prepared coaxial cable end.
Figure 18:
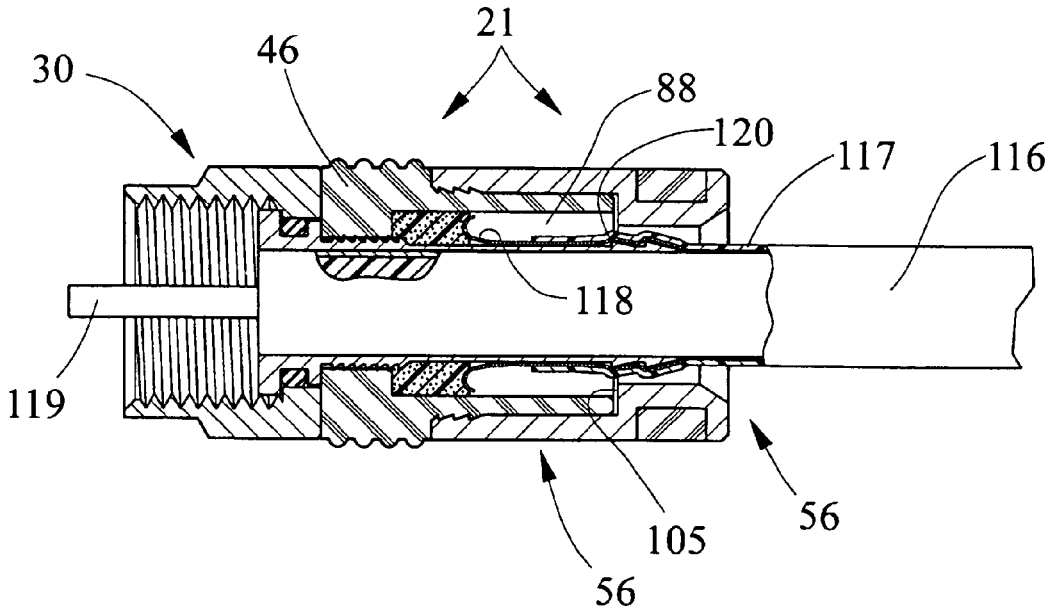

Referring primarily now to FIGS. 16-18, a prepared end of coaxial cable 116 is seen. The coaxial cable 116 has an outermost plastic covering 117, a concentric braided metal sheath 118, and an inner conductor 119. When the prepared end is first forced through the connector rear, passing through end connector hole 97 (FIG. 15) and through passageways 100, 102, the end cap 56 is uncompressed as in FIG. 17. The coaxial cable prepared end is forced through the annulus 88 between the post 70 and the inner cylindrical surface of shank 48 (FIG. 14) with post 70 coaxially penetrating the coax between the conductive braid and the insulated inner conductor. The outer metallic braid is folded back, and as seen in FIG. 18, makes electrical contact with the post 70 and portions of the end cap 56. The innermost cable conductor is routed through the post, and protrudes from the mouth 28 (i.e., FIG. 16) of the nut 30, where conductor 119 forms the male portion of the F-connector 20, 21. Axial withdrawal of the coax after compression of the end cap 56 (FIG. 18) is prevented by the reduced diameter inner wall 105 (FIGS. 15, 18), within the end cap, and by the jam point 120 (FIG. 18).

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A compressible F-connector adapted to be electrically and mechanically attached to the prepared end of a coaxial cable for thereafter establishing an electrical connection to an appropriate threaded socket, the coaxial cable comprising a center conductor surrounded by insulation that is coaxially surrounded by an outer conductive braid and an outermost insulating jacket, said F-connector comprising:

a nut adapted to be threadably coupled to said socket;

an elongated, hollow post having a flanged end mechanically coupled to said nut and a reduced diameter trailing end adapted to be inserted into said prepared cable end around the center conductor insulation and coaxially beneath said outer conductive braid;

a hollow tubular body coaxially disposed over said post, the body having a front end disposed adjacent said nut and a rear end, said body comprising an external travel limiting stop ring and an integral, elongated tubular shank disposed between said stop ring and said rear end, said shank comprising a smooth, cylindrical outer surface that is free of obstructions extending from said stop ring to said rear end, and the body having an internal passageway with a diameter greater than the diameter of said post such that an annular void is formed between said post and said body;

wherein external tactile regions are provided on said stop ring that are sensed by touch to aid in the manual assembly and positioning of the connector both before and after assembly;

a tubular end cap comprising an open end and a terminal end, the end cap comprising a smooth hollow interior, and the end cap adapted to be slidably coupled to said shank and variably positioned as desired by a user, the end cap comprising an interior passageway through which coaxial cable may pass and means for establishing an internal jam point for confining the prepared cable within the connector;

said tubular end cap comprising an external ring groove defined adjacent said terminal end and wherein a resilient O-ring is seated within said ring groove to complement the tactile regions by stimulating the sense of touch of an installer; and, wherein an annular void exists between said post and said body in which the coaxial cable outer conductive braid is restrained between said post and said body and electrically conductively contacted by said post; and, wherein the end cap is frictionally attached by compressively axially deflecting said end cap towards said nut such that the end cap will lock at any position along the cylindrical outer surface of said shank without assuming a predetermined detented position, and wherein the coaxial cable end is axially restrained after end cap compression within said connector substantially at said jam point, with an uninsulated portion of the cable center conductor extending through said nut thereby forming the male part of the resulting electrical connection.

2. The F-connector as defined in claim 1 wherein the external tactile regions comprise a plurality of convex projections defined upon said stop ring.

3. A compressible F-connector adapted to be electrically and mechanically attached to the prepared end of a coaxial cable for thereafter establishing an electrical connection to an appropriate threaded socket, the coaxial cable comprising a center conductor surrounded by insulation that is coaxially surrounded by an outer conductive braid and an outermost insulating jacket, said F-connector comprising:

a nut adapted to be threadably coupled to said socket;

an elongated, hollow post having a flanged end mechanically coupled to said nut and a barbed end adapted to be inserted into said prepared cable end around the center conductor insulation and coaxially beneath said outer conductive braid;

a hollow tubular body coaxially disposed over said post, the body comprising an elongated tubular shank having a smooth, cylindrical outer surface that is free of obstructions, and the body having an internal passageway with a diameter greater than the diameter of said post such that a an annular void is formed between said post and said body;

externally defined tactile means defined on said body sensed by touch for aiding the manual positioning of said connector, said tactile means comprising a plurality of molded convex projections;

a tubular end cap adapted to be slidably coupled to said body shank and positioned as desired by a user, the end cap comprising an interior passageway through which coaxial cable may pass, wherein said end cap comprises an external ring groove and a resilient O-ring is seated within said ring groove to aid said tactile means by stimulating the sense of touch of an installer;

means within said connector for establishing an internal jam point for confining the prepared cable within the connector;

wherein an annular void exists between said post and said body in which the coaxial cable outer conductive braid is restrained between said post and said body and electrically conductively contacted by said post; and wherein the end cap is frictionally attached to the body and compressively axially telescoped to any position along the cylindrical outer surface of said shank without assuming a predetermined detented position, and wherein an uninsulated portion of the cable center conductor extends through said nut thereby forming the male part of the resulting electrical connection.

4. The F-connector as defined in claim 3 wherein:

the body comprises a travel limiting stop ring integral with said shank for limiting end cap travel; and, the tactile means comprises a plurality of convex projections defined on said stop ring.

5. The F-connector as defined in claim 4 wherein the tactile means convex projections are arranged in columns and rows.

6. An F-connector adapted to be electrically and mechanically attached to the prepared end of a coaxial cable for thereafter establishing an electrical connection to an appropriate threaded socket, the coaxial cable comprising a center conductor surrounded by insulation that is coaxially surrounded by an outer conductive braid and an outermost insulating jacket, said F-connector comprising:

a nut adapted to be threadably coupled to said socket;

an elongated, hollow inner post having a flanged end mechanically coupled to said nut and a barbed end adapted to be inserted into said prepared cable end around the center conductor insulation and coaxially beneath said outer conductive braid;

a hollow tubular body coaxially disposed over said post, the body comprising an elongated tubular shank having a smooth, cylindrical outer surface that is free of obstructions, and the body having an internal passageway with a diameter greater than the diameter of said inner post such that a an annular void is formed between said post and said body;

a tubular end cap adapted to be slidably coupled to said body shank and positioned as desired by a user, the end cap comprising an interior passageway through which coaxial cable may pass, and wherein the cap has a hollow interior comprising teeth means for frictionally gripping the outer surface of said body shank at any desired user position;

said body comprises a travel limiting stop ring integral with said shank for limiting end cap travel;

means within said connector for establishing an internal jam point for confining the prepared cable within the connector;

wherein an annular void exists between said post and said body in which the coaxial cable outer conductive braid is positioned between said post and said body and electrically conductively contacted by said post;

wherein the end cap is frictionally attached to the body and compressively axially telescoped to any position along the cylindrical outer surface of said shank without assuming a predetermined detented position, and wherein an uninsulated portion of the cable center conductor extends through said nut thereby forming the male part of the resulting electrical connection; and, tactile means defined on said body and adapted to be sensed by touch for aiding the manual positioning of said connector, the tactile means comprising a plurality of convex projections arranged in columns and rows defined on opposite sides of said stop ring so that the tactile means may be readily sensed between the thumb and forefinger of an installer.

7. The F-connector as defined in claim 6 wherein the end cap comprises an external ring groove, and a resilient O-ring is seated within said ring groove to aid said tactile means by stimulating the sense of touch of an installer.

* * * * *